US006869269B2

(12) United States Patent
Huang et al.

(10) Patent No.: US 6,869,269 B2
(45) Date of Patent: Mar. 22, 2005

(54) FAN DEVICE WITH INCREASED AIRFLOW OUTPUT

(75) Inventors: Wen-Shi Huang, Taoyuan (TW); Kuo-Cheng Lin, Taoyuan (TW); Shun-Chen Chang, Taoyuan (TW); Wen-Hao Liu, Taoyuan (TW)

(73) Assignee: Delta Electronics, Inc., Taipei (TW)

( * ) Notice: Subject to any disclaimer, the term of this patent is extended or adjusted under 35 U.S.C. 154(b) by 0 days.

(21) Appl. No.: 10/216,337

(22) Filed: Aug. 9, 2002

(65) Prior Publication Data

US 2003/0202878 A1 Oct. 30, 2003

(30) Foreign Application Priority Data

Apr. 30, 2002 (TW) ..... 91205933 U

(51) Int. Cl.[7] ..... F04D 29/40
(52) U.S. Cl. ..... 415/116; 415/220; 416/228
(58) Field of Search ..... 415/116, 220; 416/228

(56) References Cited

U.S. PATENT DOCUMENTS 3,531,221 A * 9/1970 Hergerg et al. ..... 417/354
5,910,694 A * 6/1999 Yokozawa et al. ..... 310/89
6,132,170 A * 10/2000 Horng ..... 415/178

FOREIGN PATENT DOCUMENTS

JP 01315697 * 12/1989 ..... F04D/29/38

* cited by examiner

*Primary Examiner*—Ninh H. Nguyen
(74) *Attorney, Agent, or Firm*—Fulbright & Jaworski LLP

(57) ABSTRACT

A fan device with increased airflow output is provided, which includes: a frame having an air inlet and an air outlet, and formed with an opening penetrating through the frame; and a rotating mechanism received in the opening of the frame and connected to a driving mechanism that drives the rotating mechanism to rotate, the rotating mechanism being composed of a hub and a plurality of blades peripherally mounted to the hub, wherein each of the blades is formed with at least an extending portion, and the extending portions are adapted to expose to the air inlet for increasing contact area between the blades and ambient air. By the above fan device with increased air intake, pressure and quantity of airflow outputted from the fan device can be desirably enhanced, so as to achieve optimal heat dissipation effect for an electronic device mounted with the fan device.

13 Claims, 13 Drawing Sheets

FAN DEVICE WITH INCREASED AIRFLOW OUTPUT

FIELD OF THE INVENTION

The present invention relates to fan devices, and more particularly, to an axial-flow fan with increased pressure and quantity of airflow outputted from the fan.

BACKGROUND OF THE INVENTION

FIGS. 1 and 2 illustrate a conventional axial-flow fan 10 for heat dissipation. As shown in FIGS. 1 and 2, the axial-flow fan 10 comprises: a frame 12 with an air inlet 14 and an air outlet 16 respectively disposed at opposing top and bottom sides of the frame 12; a driving motor 18 mounted within the frame 12 for driving the fan 10 to operate; and a blade structure 20 connected to the driving motor 18. The blade structure 20 is composed of a hub 22 linked to and driven by the driving motor 18 to rotate, and a plurality of blades 26 peripherally mounted to the hub 22 and arranged vertically to an axial direction of the blade structure 20.

When the driving motor 18 of the fan 10 drives the blade structure 20 to operate, all the blades 26 on the hub 22 are adapted to rotate rapidly, allowing air to enter substantially at an axial direction into the fan 10 via the air inlet 14 of the frame 12, so as to generate airflow outputted substantially in an axial direction via the air outlet 16 of the frame 12 for use to help dissipate heat produced from an electronic device (not shown) mounted with the fan 10.

FIG. 3 illustrates a curve of pressure vs. quantity of airflow outputted from the axial-flow fan 10 operating under a predetermined rotating speed. As shown in FIG. 3, when the blade structure 20 of the fan 10 rotates at a predetermined speed, a particular PQ-curve 30 represents correlation between pressure (P) and quantity (Q) of airflow outputted from the air outlet 16. In other words, different PQ-curves are obtained for the fan 10 under different operating/rotating speeds. Thereby, the fan 10 can be adapted to operate under a desirably optimal condition according to the PQ-curve 30 and structural design of the electronic device, in an effort to achieve preferable heat dissipation performances for the electronic device.

However, in consideration of operating speed limits of the fan 10 driven by the driving motor 18 and axial flow direction of air into the fan 10, under a certain operating/rotating speed, the fan 10 may not be operatable under all conditions derived from the PQ-curve 30, and thereby may not attain to truly optimal efficacy for dissipating heat generated from the electronic device mounted with the fan 10.

SUMMARY OF THE INVENTION

A primary objective of the present invention is to provide an axial-flow fan device for increasing pressure and quantity of airflow outputted from the fan device, so as to achieve optimal heat dissipation effect for an electronic device mounted with the fan device.

In accordance with the above and other objectives, the present invention discloses a fan device, comprising: a frame having an air inlet and an air outlet, and formed with an opening penetrating through the frame; and a rotating mechanism received in the opening of the frame and connected to a driving mechanism that drives the rotating mechanism to rotate, the rotating mechanism being composed of a hub and a plurality of blades peripherally mounted to the hub, wherein each of the blades is formed with at least an extending portion, and the extending portions are adapted to expose to the air inlet for increasing contact area between the blades and ambient air.

By the above fan device with increased air intake, pressure and quantity of airflow outputted from the fan device can be desirably enhanced, so as to achieve optimal heat dissipation effect for an electronic device mounted with the fan device.

BRIEF DESCRIPTION OF THE DRAWINGS

The present invention can be more fully understood by reading the following detailed description of the preferred embodiments, with reference made to the accompanying drawings, wherein.

DETAILED DESCRIPTION OF THE PREFERRED EMBODIMENTS

Preferred embodiments of a fan device disclosed in the present invention are described with reference to FIGS. 4–13. It should be understood that, an axial-flow fan is exemplified herein; nevertheless, the invention can also be applied to other types of fans such as a centrifugal-type fan and so on.

First Preferred Embodiment

Figure 1:
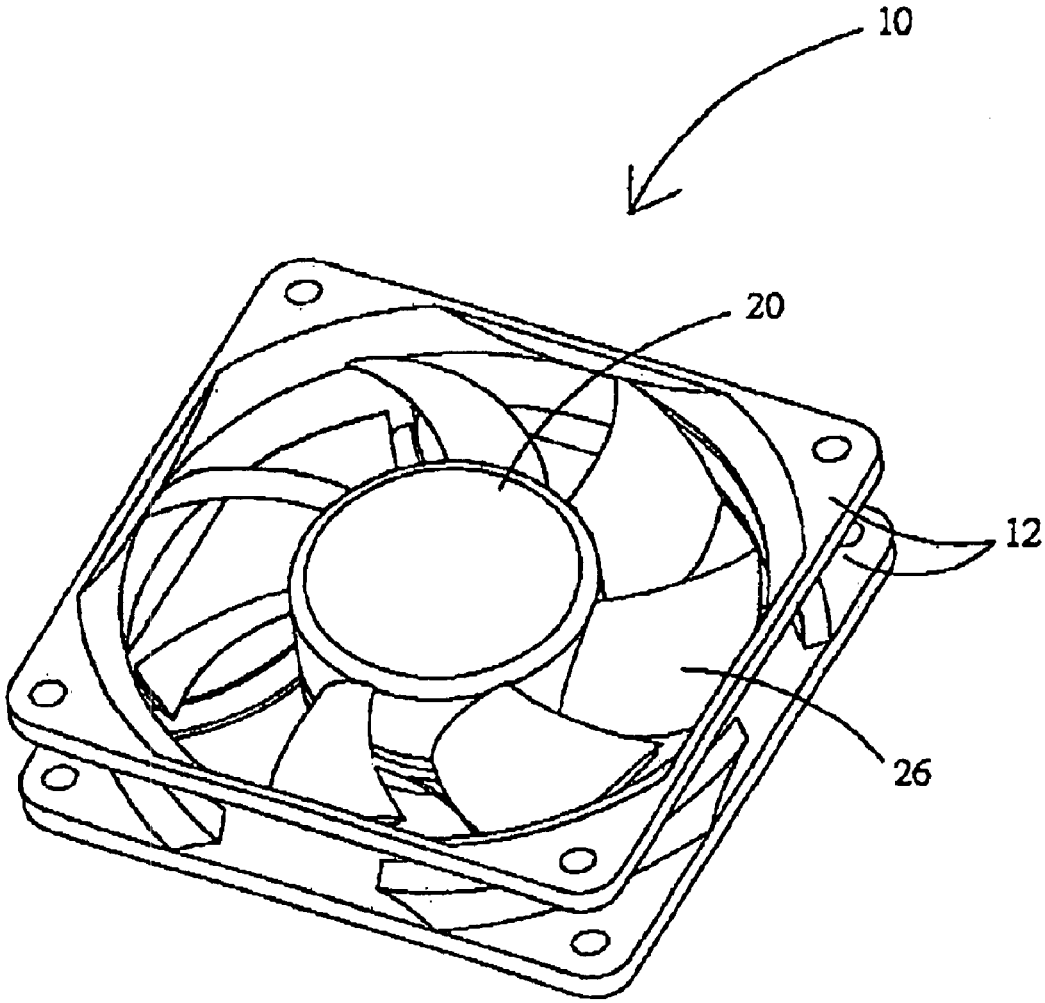
FIG. 1 (PRIOR ART)
FIG. 1 is a perspective view of an axial-flow fan according to the prior art.
Figure 2:
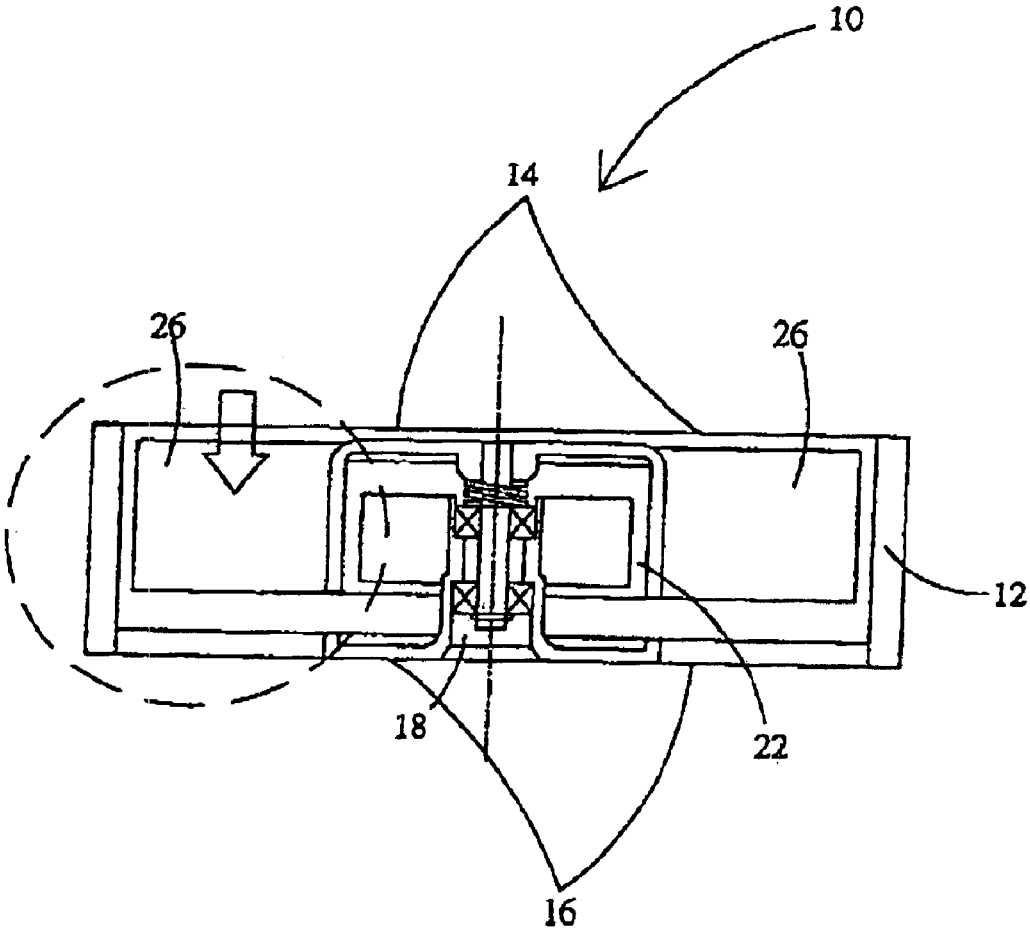
FIG. 2 (PRIOR ART)
FIG. 2 is a side view of the axial-flow fan shown in FIG. 1.
Figure 3:
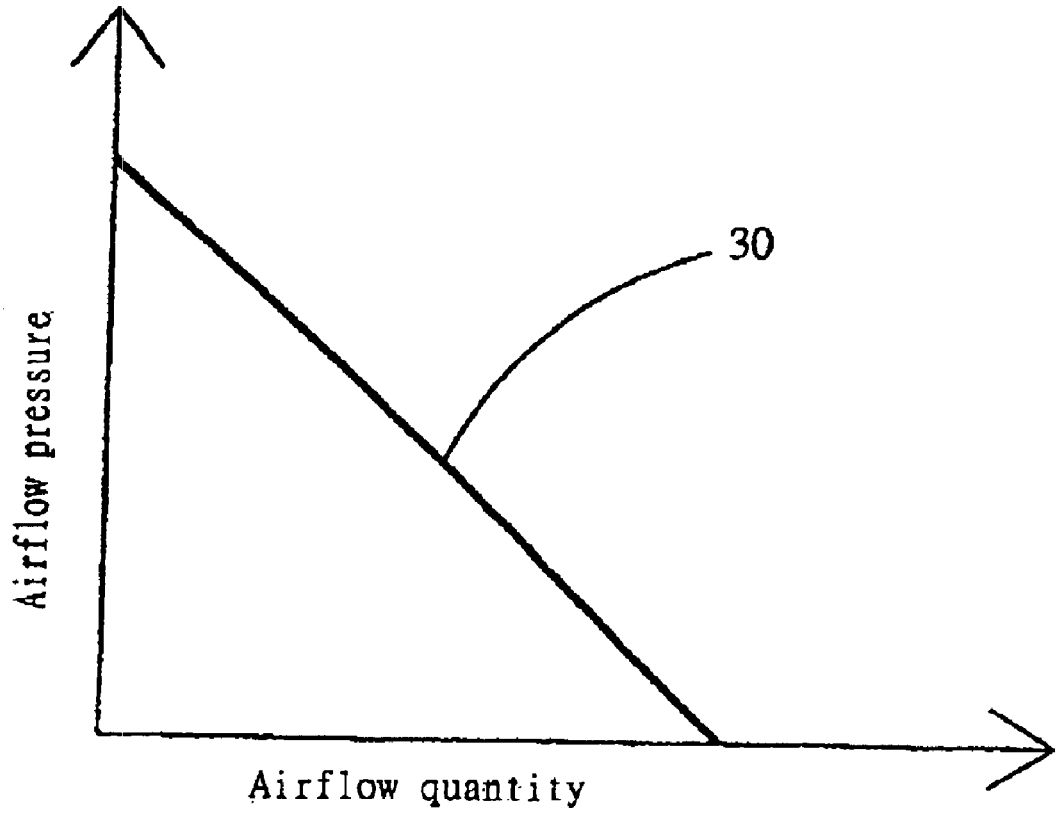
FIG. 3 (PRIOR ART)
FIG. 3 is a schematic curve of pressure vs. quantity of airflow outputted from the axial-flow fan shown in FIG. 1 operating under a predetermined rotating speed.
Figure 4:
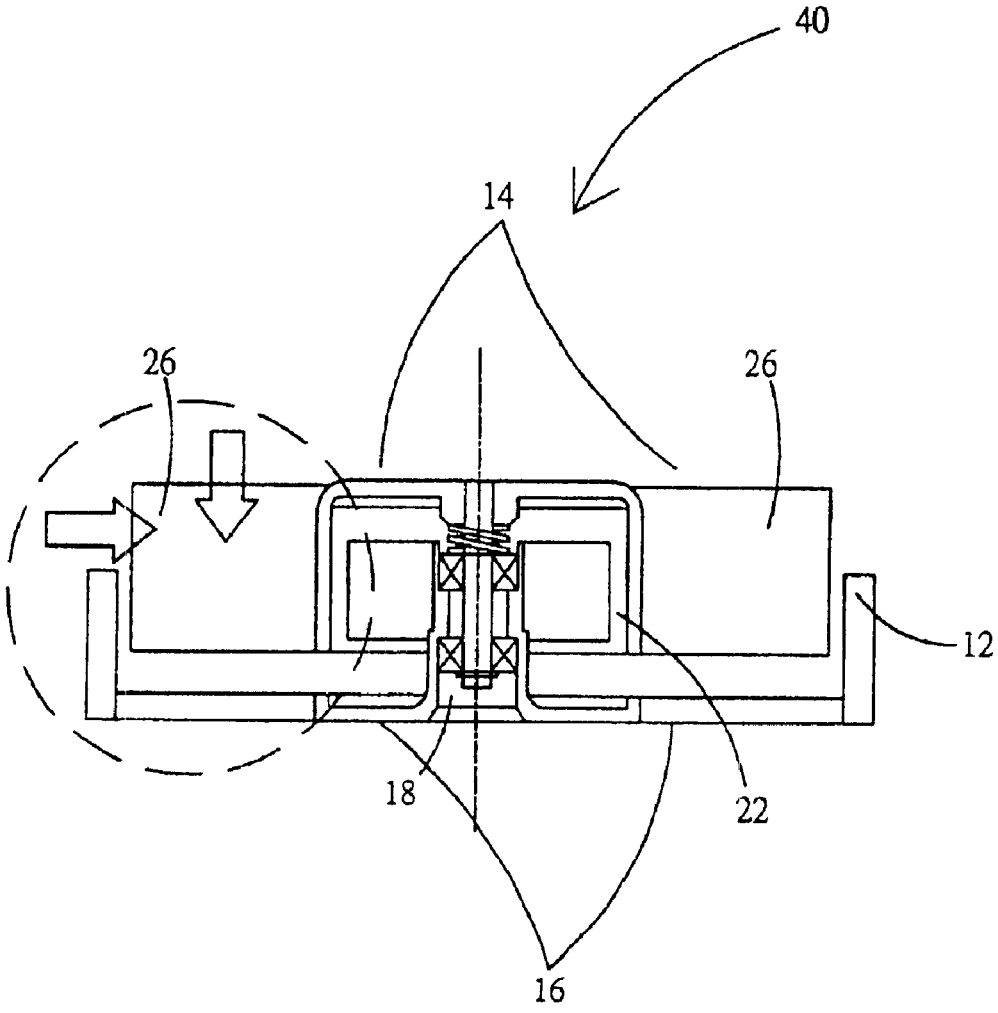
FIG. 4 is a side view of an axial-flow fan according to a first embodiment of the invention.

FIG. 4 illustrates an axial-flow fan 40 according to a first embodiment of the present invention. As shown in FIG. 4, this fan 40 is accomplished by partly removing or reducing height of the frame 12 of the foregoing conventional axial-flow fan 10 shown in FIGS. 1 and 2. In this case, same elements or components are herein designated by same reference numerals as those used in the convention fan 10.

Figure 5:
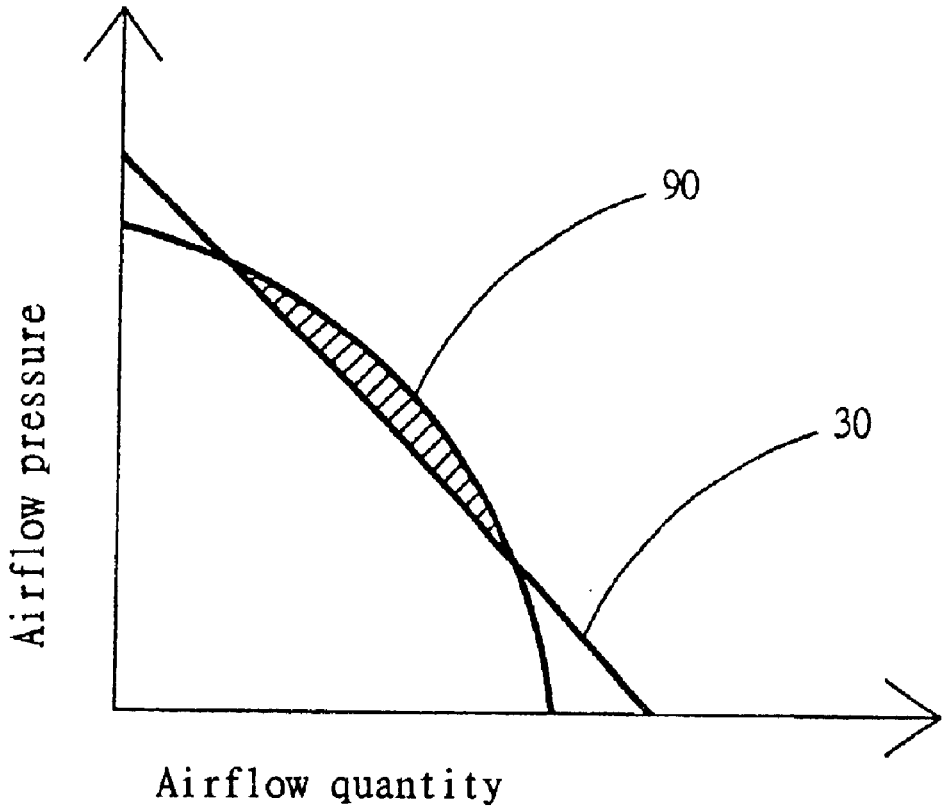
FIG. 5 is a schematic curve of pressure vs. quantity of airflow outputted from the axial-flow fan shown in FIG. 4 operating under a predetermined rotating speed in combination with FIG. 3.

As the frame 12 is reduced in height to an experimentally-predetermined optimal value, air entering into the fan 40 is adapted to flow substantially at axial and radial directions (as indicated by arrows in FIG. 4) via the air inlet 14, thereby increasing air intake for the fan 40. Under a certain operating/rotating speed of the fan 40 driven by a driving motor 18, as shown in FIG. 5, a PQ-curve 90 representing correlation between pressure and quantity of airflow outputted from the fan 40 can be obtained; as compared to the PQ-curve 30 for the conventional fan 10, the PQ-curve 90 with a shadowed portion indicates that, the fan 40 is capable of operating under more conditions derived from the shadowed portion in FIG. 5 so as to increase pressure and quantity of airflow generated from the fan 40.

Second Preferred Embodiment

Figure 6:
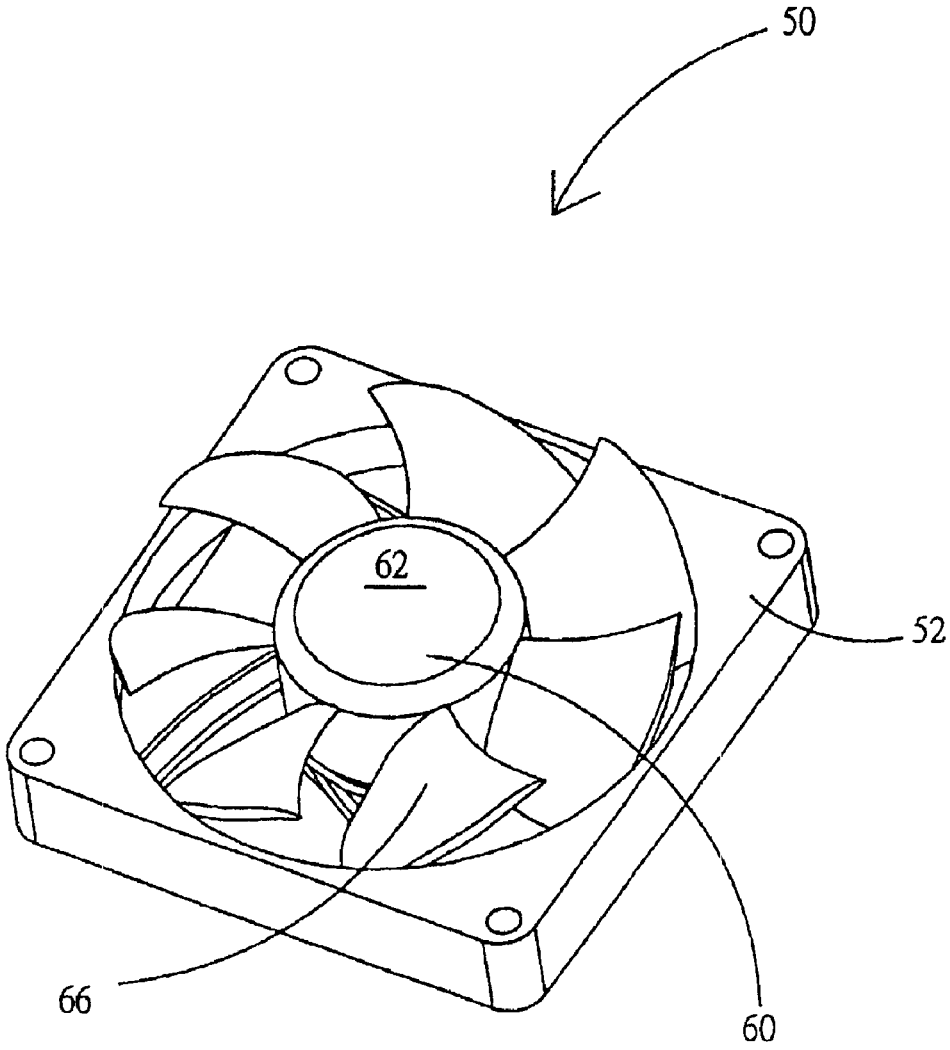
FIG. 6 is a perspective view of the axial-flow fan according to a second embodiment of the invention.
Figure 7:
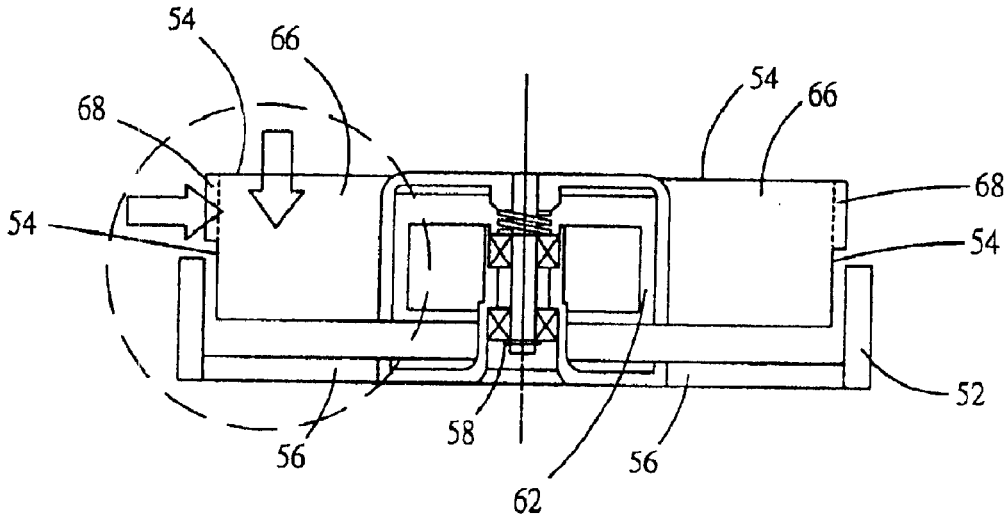
FIG. 7 is a side view of the axial-flow fan shown in FIG. 6.

FIGS. 6 and 7 illustrate an axial-flow fan 50 according to a second embodiment of the invention.

As shown in FIGS. 6 and 7, the fan 50 comprises a frame 52 having an air inlet 54 and an air outlet 56 respectively disposed at opposing top and bottom sides of the frame 52, a driving motor 58 mounted within the frame 52 for driving the fan 50 to operate, and a blade structure 60 connected to the driving motor 58 and driven to rotate by the driving motor 58.

The blade structure 60 is composed of a hub 62 coupled to and driven by the driving motor 58 to rotate, and a plurality of blades 66 peripherally mounted to the hub 62 and arranged vertically to an axial direction of the blade structure 60. Each of the blades 66 is integrally formed with at least an extending portion 68 corresponding in position to the air inlet 54 of the frame 52, allowing the extending portion 68 to be exposed to the air inlet 54 and thus to increase an outer diameter of the corresponding one of the blades 66.

It should be noted that, the extending portions 68 are not essentially made of the same material as the blades 66; separately-fabricated extending portions 68 can be connected to the corresponding blades 66 by conventional bonding technology such as welding, soldering or surface mount technology (SMT). Moreover, height of the frame 52 can be modified according to practical requirements, for example, to reduce to an experimentally-predetermined optimal value of height as discussed in the above first embodiment.

When the fan 50 is driven by the driving motor 58 to operate under a predetermined speed, all the blades 66 of the blade structure 60 are adapted to rotate accordingly, and the extending portions 68 provided on the blades 66 would desirably increase contact area between the blades 66 and air around the air inlet 54, thereby allowing more air to enter via the air inlet 54 in to the fan 50. This arrangement results in a different PQ-curve 100 (as shown in FIG. 8) for the fan 50, as compared to the above PQ-curves 30, 90 respectively for the conventional fan 10 and the fan 40 in the first embodiment.

Figure 8:
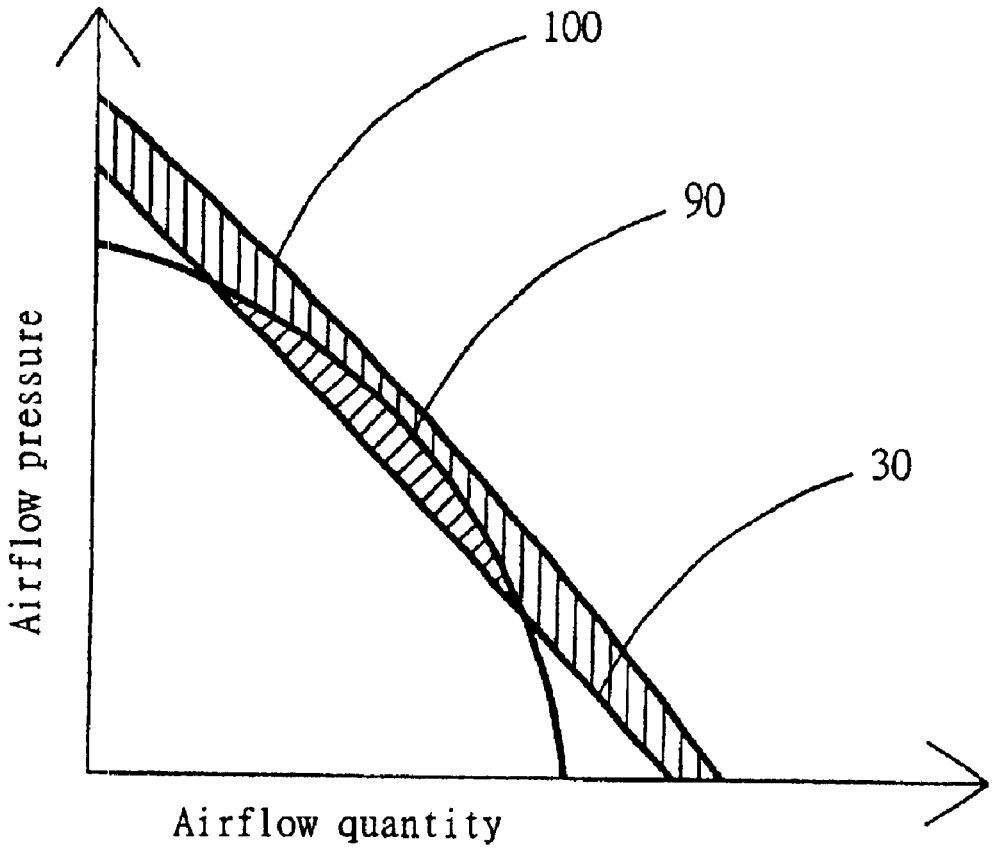
FIG. 8 is a schematic curve of pressure vs. quantity of airflow outputted from the axial-flow fan shown in FIG. 6 operating under a predetermined rotating speed in combination with FIGS. 3 and 5.

As shown in FIG. 8, under a certain operating speed of the fans 10, 40, 50 driven by the driving motors 18, 58, the PQ-curve 100 for the fan 50 with a larger shadowed portion indicates enhanced improvement in operational performances of the fan 50 in comparison with the PQ-curves 30, 90 for the fans 10, 40 respectively. Therefore, the fan 50 can be adapted to operate under more conditions derived from the shadowed portion in FIG. 8 so as to increase pressure and quantity of airflow generated from the fan 50 in accompany with improved air intake achieved by the extending portions 68 of the blades 66.

Third Preferred Embodiment

Figure 9:
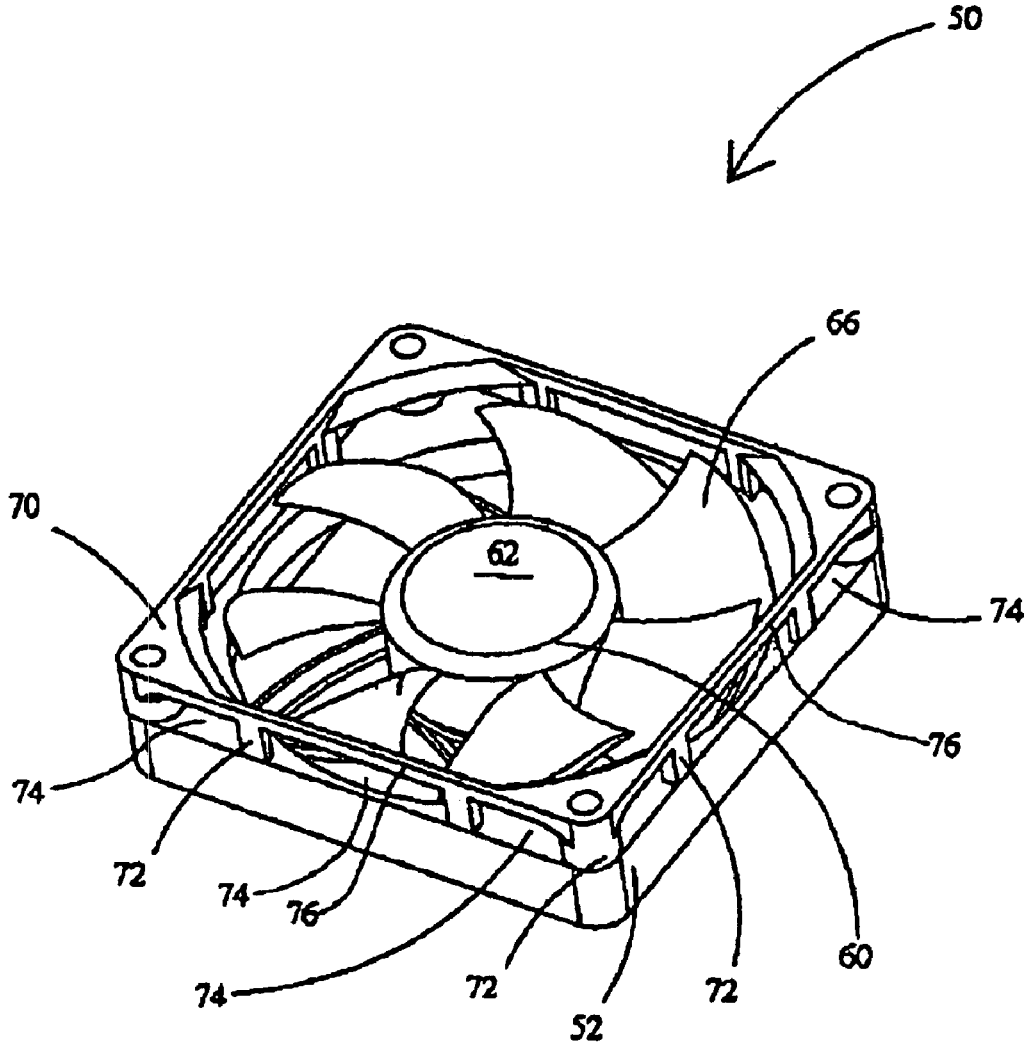
FIG. 9 is a perspective view of the axial-flow fan according to a third embodiment of the invention.
Figure 10:
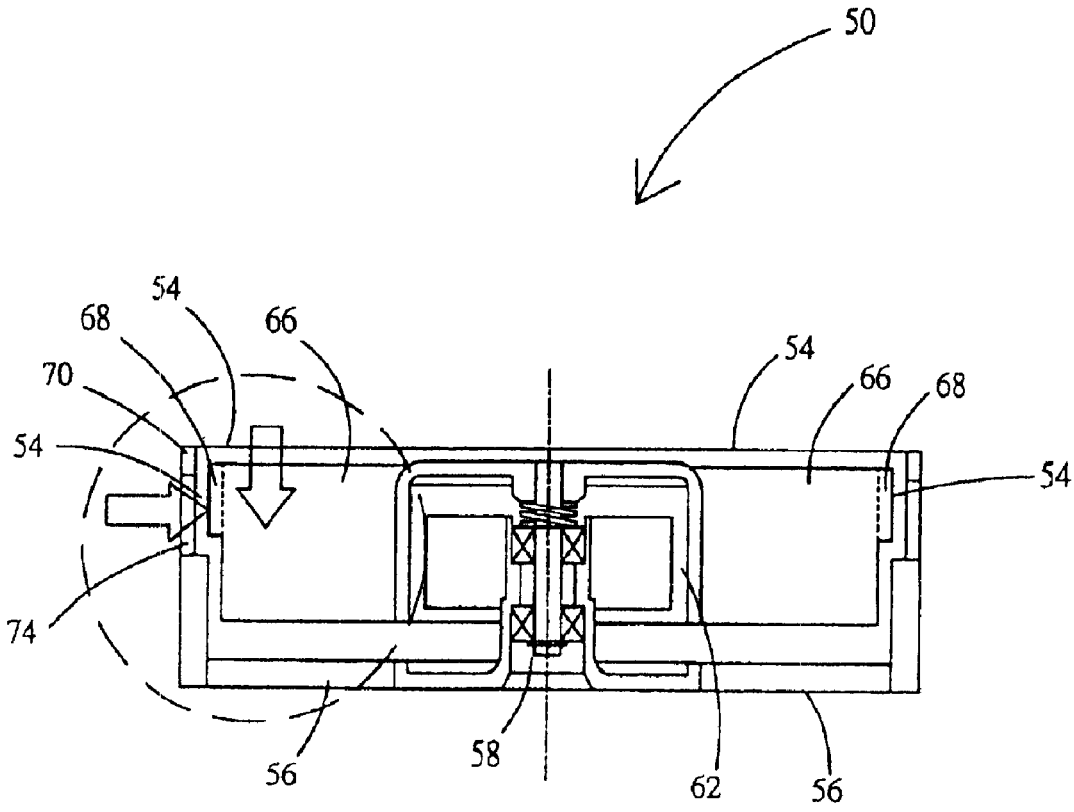
FIG. 10 is a side view of the axial-flow fan shown in FIG. 9.

FIGS. 9 and 10 illustrate an axial-flow fan 80 according to a third embodiment of the invention. The fan 80 is structurally similar to the above fan 50 in the second embodiment, and thus, same elements or components are designated herein by same reference numerals as those used in the second embodiment.

As shown in FIGS. 9 and 10, the fan 80 differs from the foregoing fan 50 in that, this fan 80 is further provided with an auxiliary frame 70 surrounding the blade structure 60. The auxiliary frame 70 is formed at the periphery thereof with a plurality of supporting posts 72, and the supporting posts 72 can be coupled to corresponding coupling holes (not shown) formed on the periphery of the frame 52 in a manner that, the auxiliary frame 70 is fixed in position above the frame 52. The auxiliary frame 70 further includes at least one stick 76 disposed between two adjacent supporting posts 72. There might be only one stick 76 connected between two adjacent supporting posts 72 or several parallel sticks 76 connected between two adjacent supporting posts. The auxiliary frame 70 may be integrally fabricated at the periphery of the frame 52.

By the above structural arrangement, a user can simply hold at the auxiliary frame 72 and the frame 52 for handling the fan 80 without being hurt by the blades 66 if the blades 66 have not stopped rotating.

By interval arrangement of the supporting posts 72, a radial air inlet 74 is formed between two adjacent supporting posts 72 and the frame 52, such that air can be guided to flow at a radial direction into the fan 80 as the blades 66 and extending portions 68 of the blade structure 60 rotate. This desirably enhances air intake for the fan 80, and thereby helps increase pressure and quantity of airflow outputted from the fan 80.

Fourth Preferred Embodiment

Figure 11:
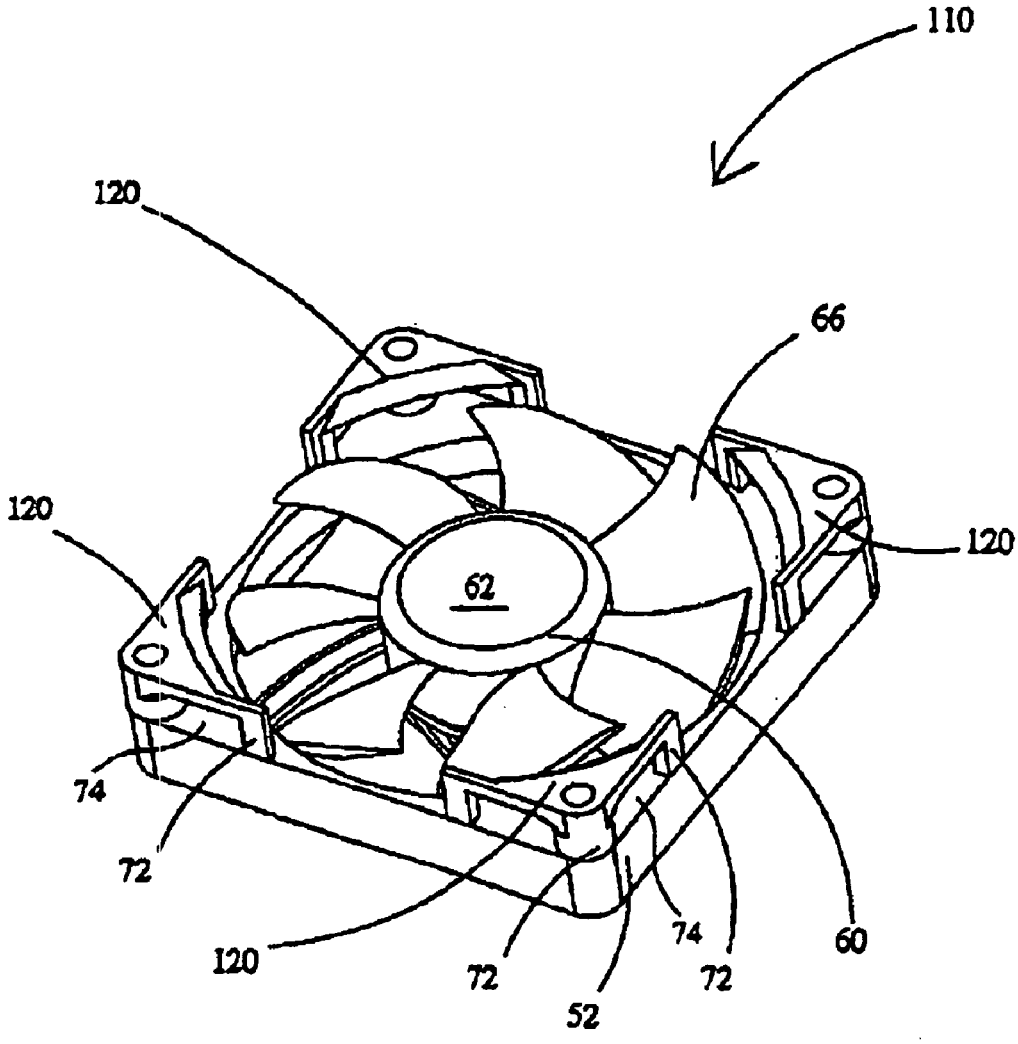
FIG. 11 is a perspective view of the axial flow fan according to a fourth embodiment of the invention.
Figure 12:
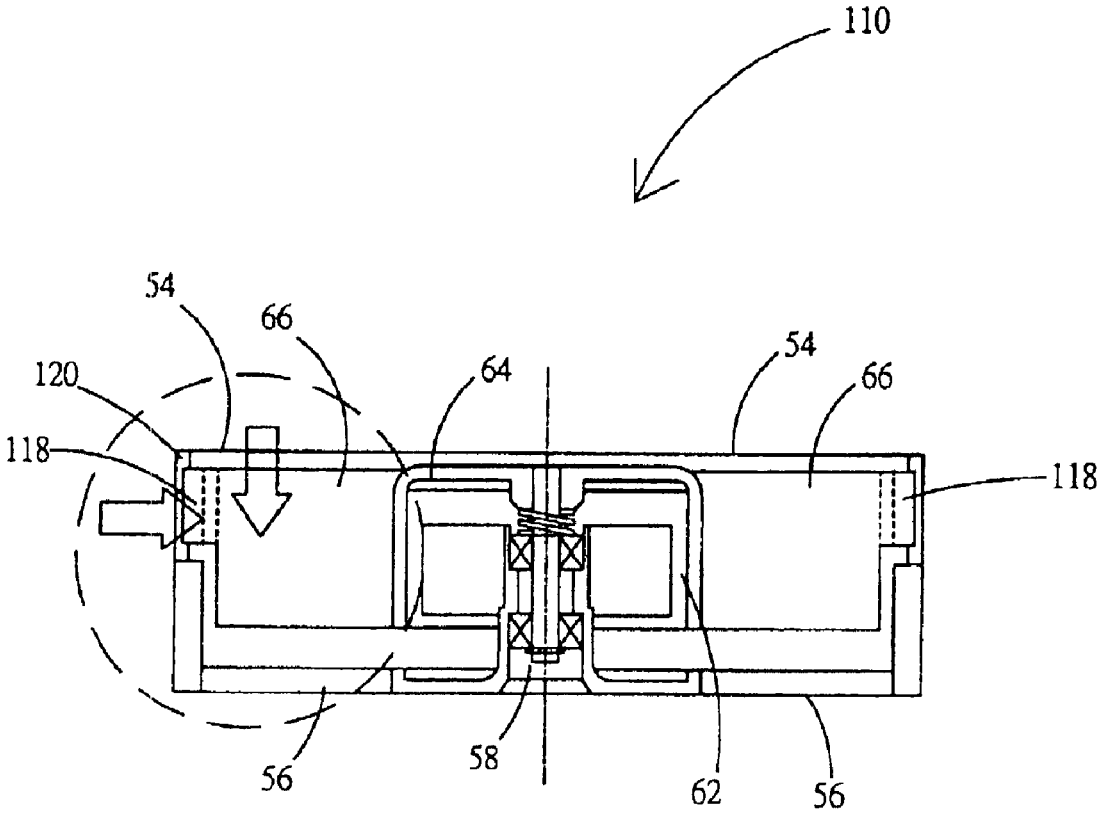
FIG. 12 is a side view of the axial-flow fan shown in FIG. 11.

FIGS. 11 and 12 illustrate an axial-flow fan 110 according to a fourth embodiment of the invention. The fan 110 is structurally similar to the above fan 80 in the third embodiment, and thus, same elements or components are designated herein by same reference numerals as those used in the third embodiment.

As shown in FIGS. 11 and 12, this fan 110 is accomplished by partly removing the auxiliary frame 70 of the above fan 80 in the third embodiment, in a manner as to form four corner-situated auxiliary frames 120 shown in FIG. 11. By this structural arrangement, the extending portions 68 connected to the blades 66 increase a contact area between the blades 66 and ambient air. Also, at least one radial air inlet 74 is formed between two adjacent supporting posts 72 and the frame 52 for guiding ambient air passing therethrough so as to increase airflow intake. This feature thereby further facilitates air intake for the fan 110 by virtue of enhance contact area between air and the blades 66 with enlarged extending portions 68.

Figure 13:
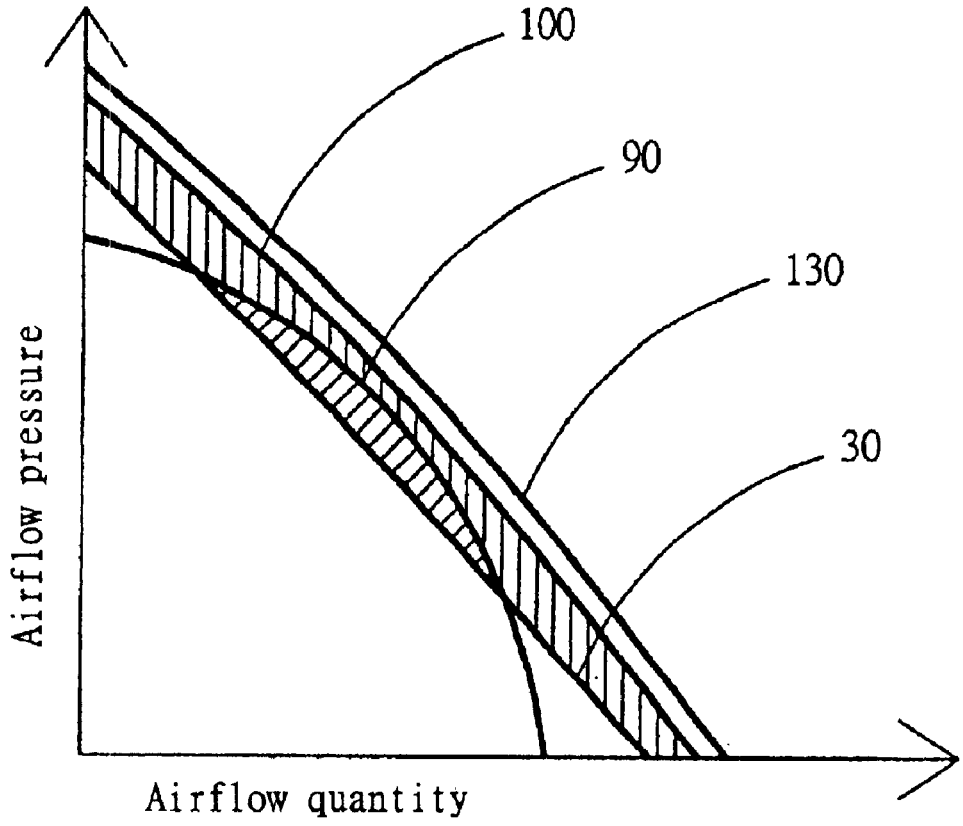
FIG. 13 is a schematic curve of pressure vs. quantity of airflow outputted from the axial-flow fan shown in FIG. 11 operating under a predetermined rotating speed in combination with FIGS. 3, 5 and 8.

As shown in FIG. 13, when the fans 10, 40, 50, 110 are driven by the driving motors 18, 58 to operate under a certain speed, a PQ-curve 130 for the fan 110 with further improved pressure and quantity of outputted airflow can be obtained, as compared to the PQ-curves 30, 90, 100 for the fans 10, 40, 50. As a result, the fan 110 of this embodiment may be more effectively used to dissipate heat generated from an electronic device mounted with the fan 110, so as to achieve optimal heat dissipation effect for the electronic device.

It should be understood that, a plurality of the above fans 50, 80, 110 can also be flexibly arranged in parallel (for increasing quantity of outputted airflow) or in series (for increasing pressure of outputted airflow) according to practical requirements.

As compared to the prior art technology, the above embodied fans of the invention provide significant benefits. The extending portions formed with the blades effectively increase contact area between the blades and ambient air, such that air intake for the fan is enhanced, as well as pressure and quantity of airflow outputted from the fan can be considerably improved. Moreover, with provision of an auxiliary frame and a plurality of radial air inlets, airflow output may be further enhanced through the use of the fan that can accordingly more efficiently dissipate heat generated from an electronic device mounted with the fan according to the invention.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. An axial flow fan device, comprising:

a first frame having an air inlet and an air outlet;

a driving mechanism mounted within the first frame for driving the fan device to operate;

a rotating mechanism having a hub coupled to the driving mechanism, and a plurality of blades peripherally disposed around the hub; and a second frame having at least one radial air inlet for guiding ambient air passing therethrough so as to increase airflow intake, the second frame further comprising at least one corner-situated auxiliary frame on the first frame, and at least one of the radial air inlets is formed between two adjacent supporting posts and the first frame.

2. The fan device of claim 1, wherein the second frame is fixed on a peripheral area of the first frame and positioned in elevation higher than the blades.

3. The fan device of claim 2, wherein the first frame and the second frame are integrally fabricated.

4. The fan device of claim 1, wherein each of the corner-situated auxiliary frames comprises at least one supporting post, and each of the radial air inlets is formed between two adjacent supporting posts and the first frame.

5. The fan device of claim 4, wherein the supporting posts are coupled to a plurality of corresponding bores formed on the peripheral area of the first frame, so as to fix the corner-situated auxiliary frames in position on the first frame.

6. An axial flow fan device, comprising:

a first frame having an air inlet and an air outlet;

a driving mechanism mounted within the first frame for driving the fan device to operate;

a rotating mechanism having a hub coupled to the driving mechanism, and a plurality of blades peripherally disposed around the hub:

a plurality of extending portions, each of which is connected to one of the blades, respectively, wherein each of the blades is dimensioned in height larger than the first frame, and the extending portions are exposed to the air inlet of the first frame so as to increase a contact area between the blades and ambient air; and a second frame having at least one radial air inlet for guiding ambient air passing therethrough so as to increase airflow intake, the second frame further comprising at least one corner-situated auxiliary frame on the first frame, and at least one of the radial air inlets is formed between two adjacent supporting posts.

7. The fan device of claim 6, wherein the first frame and the corner-situated auxiliary frames are integrally fabricated.

8. The fan device of claim 6, wherein each of the corner-situated auxiliary frames has at least one supporting post and each of the radial inlets is formed between two adjacent supporting posts and the first frame.

9. The fan device a claim 6, wherein the extending portions are made of the same material as used for the blades, and positioned in elevation higher than the first frame.

10. The fan device of claim 8, wherein the supporting posts are coupled to a plurality of corresponding bores formed on the peripheral area of the first frame, so as to fix the corner-situated auxiliary frames in position on the first frame.

11. The fan device of claim 6, the second frame further comprises at lest one stick disposed between two adjacent supporting posts.

12. The fan device of claim 6, second frame further comprises at least one stick connected between two adjacent supporting posts.

13. The fan device of claim 6, wherein the corner-situated auxiliary frames are fixed on peripheral area of the first frame and positioned in elevation higher than the blades.

* * * * *